United States Patent [19]

Brown

[11] Patent Number: 4,832,758

[45] **Date of Patent: * May 23, 1989**

[54] PRODUCING COMBINED HIGH STRENGTH AND HIGH CORROSION RESISTANCE IN AL-ZN-MG-CU ALLOYS

[75] Inventor: Melvin H. Brown, Leechburg, Pa.

[73] Assignee: Aluminum Company of America, Pittsburgh, Pa.

[ * ] Notice: The portion of the term of this patent subsequent to Oct. 16, 2001 has been disclaimed.

[21] Appl. No.: 82,414

[22] Filed: Aug. 6, 1987

Related U.S. Application Data

[63] Continuation of Ser. No. 142,541, Apr. 21, 1980, abandoned, which is a continuation of Ser. No. 410,109, Oct. 26, 1973, abandoned.

[51] Int. Cl.[4] ..... C22F 1/04

[52] U.S. Cl. ..... 148/12.7 A; 148/159; 148/417

[58] Field of Search ..... 148/159, 12.7 A, 415–418

[56] References Cited

U.S. PATENT DOCUMENTS

| | | | |
|---|---|---|---|
| 2,248,185 | 7/1941 | Nock | 148/21.1 |
| 3,198,676 | 8/1965 | Sprowls et al. | 148/159 |
| 3,231,435 | 1/1966 | Rotsell et al. | 148/159 |
| 3,287,185 | 11/1966 | Vachet et al. | 148/159 |
| 3,305,410 | 2/1967 | Sublett et al. | 148/159 |
| 3,563,814 | 2/1971 | Lyle et al. | 148/12.7 |
| 3,645,804 | 2/1972 | Ponchel | 148/128 |
| 3,791,876 | 2/1974 | Kroger | 148/2 |
| 3,836,405 | 9/1974 | Staley et al. | 148/12.7 |
| 3,856,584 | 12/1974 | Cina | 148/159 |
| 3,881,966 | 5/1975 | Staley et al. | 148/12.7 |
| 3,945,861 | 3/1976 | Anderson et al. | 148/12.7 |
| 3,947,297 | 3/1976 | Reimann et al. | 148/159 |
| 4,063,936 | 12/1977 | Nagase et al. | 75/141 |
| 4,069,072 | 1/1978 | Develay et al. | 148/32 |
| 4,126,448 | 11/1978 | Moore et al. | 75/146 |
| 4,189,334 | 2/1980 | Dubost et al. | 148/159 |
| 4,193,822 | 3/1980 | Adam et al. | 148/3 |
| 4,200,476 | 4/1980 | Dubost et al. | 148/12.7 |
| 4,305,763 | 12/1981 | Quist et al. | 148/12.7 |
| 4,431,467 | 2/1984 | Staley et al. | 148/159 |
| 4,477,292 | 10/1984 | Brown | 148/20 |

FOREIGN PATENT DOCUMENTS

| | | |
|---|---|---|
| 60-130047 | 1/1985 | Japan . |
| 60-180637 | 9/1985 | Japan . |
| 61-238937 | 10/1986 | Japan . |
| 62-142753 | 6/1987 | Japan . |
| 1049912 | 11/1966 | United Kingdom . |
| 1476942 | 6/1977 | United Kingdom . |
| 1480351 | 7/1977 | United Kingdom . |

OTHER PUBLICATIONS

Investigation to Improve the Stress-Corrosion Resistance of Aluminum Aircraft Alloys Through Alloy Additions and Specialized Heat Treatment, J. T. Staley Under Navair N00019-68-C-0146, Defense Documentation Center, Oct. 1, 1972.

"Precipitation Hardening and Stress Corrosion in $AlZnMg_3$", W. Grunhl et al, *Z. Metallkunde*, vol. 55, No. 10, pp. 577–582 (1964).

"Thermomechanical Treatments on High Strength Al-Zn-Mg(-Cu) Alloys", *Metallurgical Transactions*, vol. 4, pp. 1133–1144 (Apr. 1973).

"New Technique for Reducing Susceptibility to Stress--Corrosion of High Strength Aluminum Alloys", Published by the Pittsburgh Chapter of the American Society for Metals (1974).

"A New Approach to the Problem of Stress Corrosion Cracking in 7075-T6 Aluminum", Canadian Aeronautics and Space Journal, vol. 27, No. 3, pp. 222–232 (1981).

"Microstructural Study of a High-Strength Stress-Corrosion Resistant 7075 Aluminum Alloy", *Journal of Materials Science*, vol. 17, pp. 2817–2824 (1982).

"Retrogression and Reaging Response of 7475 Aluminum Alloy", *Metals Technology*, vol. 10, pp. 386–392 (Oct. 1983).

*Primary Examiner*—R. Dean

*Attorney, Agent, or Firm*—Carl R. Lippert; Daniel A. Sullivan, Jr.; Gary P. Topolosky

[57] ABSTRACT

The method of thermally treating an article composed of an alloy consisting essentially of aluminum, 4 to 8% zinc, 1.5 to 3.5% magnesium, 1 to 2.5% copper, and at least one element selected from the group consisting of 0.05 to 0.3% chromium, 0.1 to 0.5 manganese, and 0.05 to 0.3% zirconium, which method includes the steps of solution heat treating the article, then precipitation hardening the article at 173° to 325° F., then subjecting the article to a time and temperature within the perimeter ABCD of FIG. 4, and then again precipitation hardening at 175° to 325° F.

75 Claims, 2 Drawing Sheets

PRODUCING COMBINED HIGH STRENGTH AND HIGH CORROSION RESISTANCE IN AL-ZN-MG-CU ALLOYS

This application is a continuation, of application Ser. No. 142,541, filed Apr. 21, 1980, which is a continuation of Ser. No. 410,109, now abandoned.

BACKGROUND OF THE INVENTION

The present invention relates to a method of thermally treating particles containing an alloy based on aluminum.

The precipitation hardened condition of aluminum alloy 7075, referred to as the T6 condition of alloy 7075, has not given sufficient resistance to corrosion under certain service conditions. The T73 temper improves the resistance of precipitation hardened 7075 alloy to stress corrosion cracking, although it decreases strength significantly vis-a-vis the T76 condition.

SUMMARY OF THE INVENTION

An object of the present invention is to provide a new heat treating method to produce an aluminum alloy in a unique heat treated condition for providing favorable resistance to corrosion combined with high strength.

Another object is to provide a new method for providing resistance to stress corrosion cracking in 7075 aluminum alloy.

These as well as other objects which will become apparent in the discussion which follows are achieved, according to the present invention, by the method of thermally treating an article composed of an alloy consisting essentially of aluminum, 4 to 8% zinc, 1.5 to 3.5% magnesium, 1 to 2.5% copper, and at least one element selected from the group consisting of 0.05 to 0.3% chromium, 0.1 to 0.5% manganese, and 0.05 to 0.3% zirconium, which method includes the steps of solution heat treating the article, then precipitation hardening the article at 175° to 325° F., then subjecting the article to a time and temperature within the perimeter ABCD of FIG. 4, and then again precipitation hardening at 175 to 325° F.

BRIEF DESCRIPTION OF THE DRAWING

FIG. 1 shows a prior art solution heat treated and stress relieved condition referred to as the W51 condition.

FIG. 2 shows the prior art precipitation hardened condition referred to as the T6 condition.

FIG. 3 shows the prior art stress corrosion cracking resistant condition referred to as the T73 condition.

DESCRIPTION OF THE PREFERRED EMBODIMENTS

Figure 1:
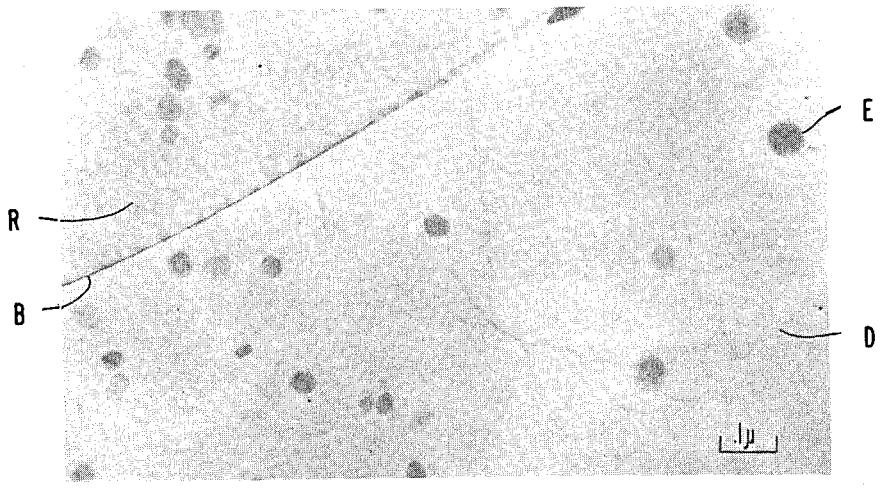
FIG. 1 (PRIOR ART)
FIGS. 1-3 are transmission electron micrographs of sections in a plate of aluminum alloy 7075. The distance equivalent to 0.1 micron is indicated on the micrographs. The metal surfaces reproduced in the micrographs all were perpendicular to the direction of rolling of the plate.

The alloys in the present invention have a composition containing 4 to 8% zinc, 1.5 to 3.5% magnesium, 1 to 2.5% copper, and at least one element selected from the group made up by chromium at 0.05 to 0.3%, manganese at 0.1 to 0.5%, and zirconium at 0.05 to 0.3%. The balance of the composition is essentially aluminum.

Alloys designated 7075 by the aluminum industry are preferred for the present invention and have a composition containing 5.1 to 6.1% zinc, 2.1 to 2.9% magnesium, 1.2 to 2.0% copper, 0.18 to 0.35% chromium, 0.30% maximum manganese, 0.40% maximum silicon, 0.50% maximum iron, 0.20% maximum titanium, others each 0.05% maximum and others total 0.15% maximum, balance aluminum.

The alloys used in the present invention may also contain one or more of the group of grain refining elements including titanium at 0.01 to 0.2% and boron at 0.0005 to 0.002%. These elements serve to produce a fine grain size in the cast form of the alloy. This is generally advantageous to mechanically properties.

In addition, it may be helpful to add 0.001 to 0.005% beryllium for the purpose of minimizing oxidation at times when the alloy is molten.

Iron and silicon are generally present as impurities. Up to 0.5% iron can be tolerated, and the silicon content should not exceed 0.4%, in order to avoid the formation of any substantial amount of the intermetallic compound $Mg_2Si$.

Figure 4:
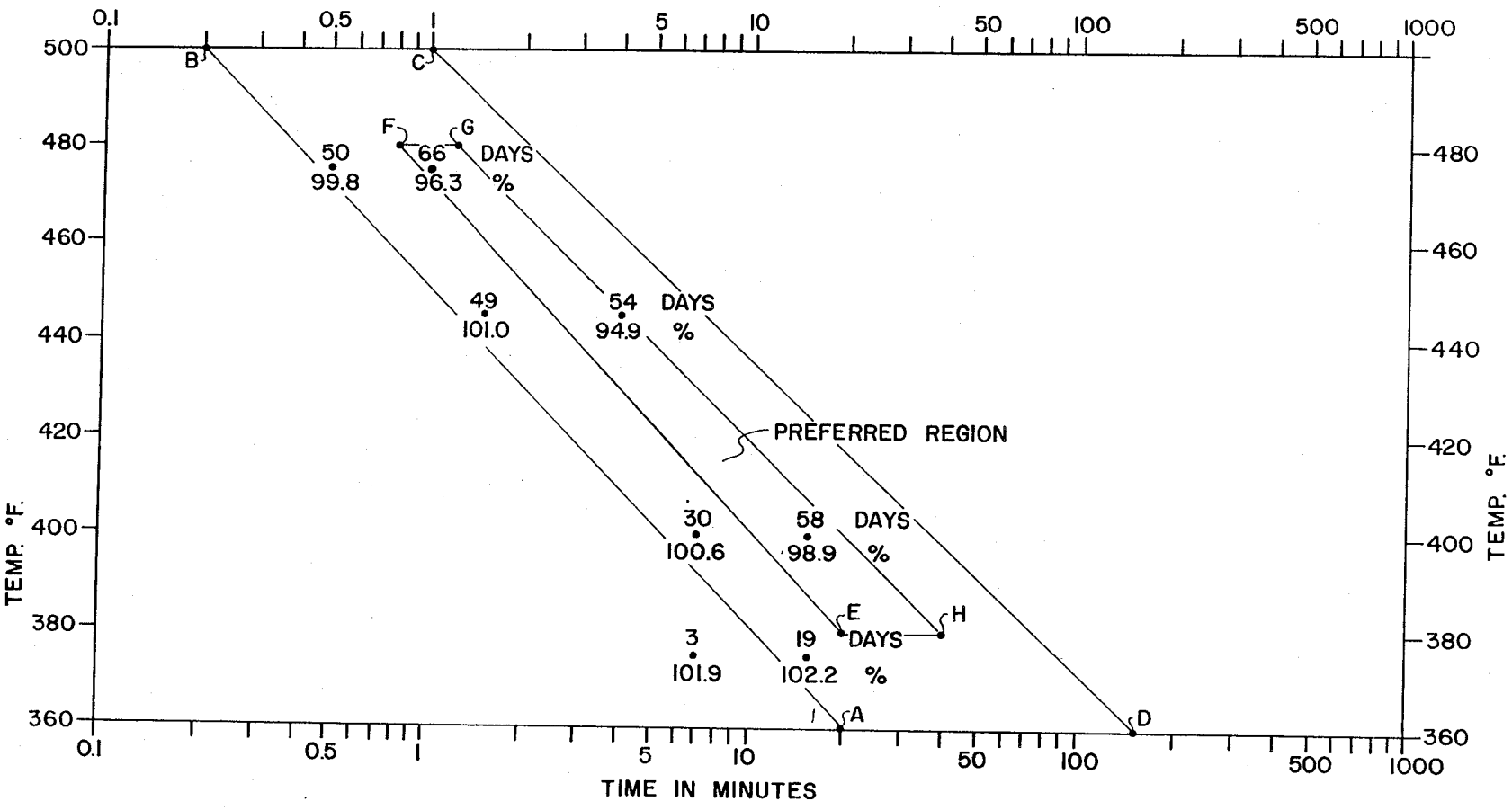
FIG. 4 is a graph showing characteristics of the invention.

A preferred heat treatment according to the present invention for obtaining improved stress-corrosion resistance is to immerse alloy, as above defined, in the precipitationhardened, T6 condition into molten metal for a time and temperature within the perimeter of the quadrilateral EFGH in FIG. 4, then precipitation harden again.

In its broader aspects, a T6 condition may be obtained by precipitation hardening solution heat treated alloy at 175° to 325° F. Typical conditions may be:

a. For alloys containing less than 7.5% zinc, heating a solution heat treated article to 200° to 275° F. and holding for a period of 5 to 30 hours;

b. For alloys containing more than 7.5% zinc, heating a solution heat treated article to 175° to 275° F. and holding for a period of 3 to 30 hours.

A usual practical for obtaining the T6 condition is obtained by heating a specimen for 24 hours at 250° F. in a circulatory-air furnace.

According to another preferred embodiment of the invention, the alloy is solution heat treated, then precipitation hardened at a temperature of 175° to 325° F., then subjected to a time and temperature within the perimeter ABCD, more preferably EFGH, and then again precipitation hardened for a time of 2 to 30 hours at a temperature of 270° to 320° F.

The article of J. T. Staley et al. entitled "Heat Treating Characteristics of High Strength Al-Zn-Mg-Cu Alloys With and Without Silver Additions" appearing at pages 191 to 199 in the January, 1972 issue of *Metallurgical Transactions,* published by ASM/AIME, shows that solution heat treat quench rate, the lapse of time between the solution heat treat quench and the beginning of heating for precipitation hardening, and the heating rate for precipitation hardening may effect the maximum yield strength obtainable in 7075 aluminum alloys. It is intended that, within the concepts of the present invention, the teachings of Staley et al. be used in the present invention for optimizing results. Thus, it may be advantageous for increasing strength to immerse specimens, which have had their solution heat treatment quench, for example, 1½ years ago, into molten Wood's metal according to the invention.

Figure 2:
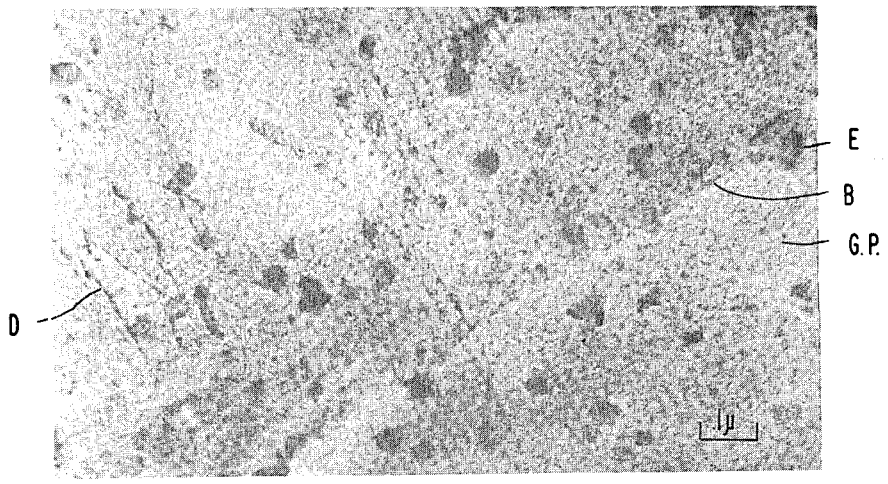
FIG. 2 (PRIOR ART)
Figure 3:
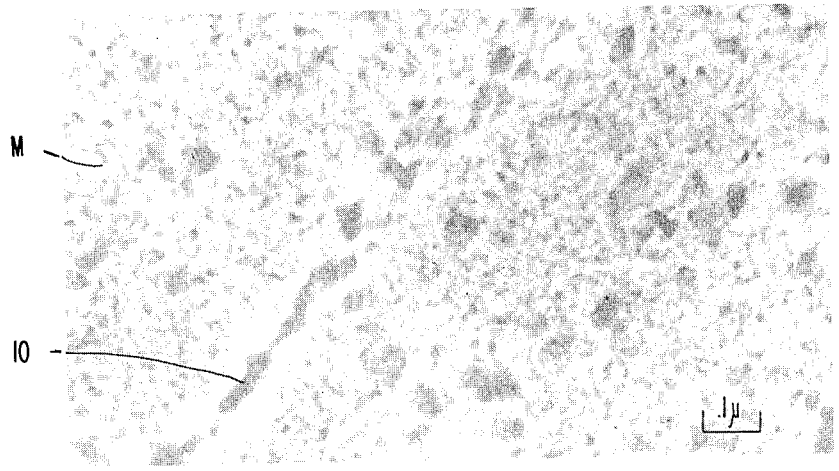
FIG. 3 (PRIOR ART)

Referring now to FIGS. 1 to 3, transmission electron micrographs of various microstructures important for consideration of the present invention are presented. All of FIGS. 1 to 3 were taken from a single ¼-inch thick 7075 aluminum alloy plate of composition A in Table I. FIGS. 1 to 3 are microstructures of prior art conditions of 7075 aluminum. In FIG. 1, an example of the W51 solution heat treated condition is given. A W51 solution heat treated microstructure is obtained in 7075 aluminum alloy plate by heating to 900° F. and then quenching in water at room temperature. The plate material is then stretched to from 1½ to 3% permanent set for stress relief. This gives the microstructure shown in FIG. 1, including E-phase particles of Al-Mg-Cr precipitate, matrix regions R of single phase aluminum solid-solution material, grain boundaries B and dislocations D. The mottling effect appearing in the matrix region of FIG. 1 is an artifact of the action of the thinning solution used in preparing thinned material for transition electron microscopy.

TABLE I

Composition of Alloys, in Weight-%.

| Element | Alloy A | Alloy B |
|---|---|---|
| Cu | 1.45 | 1.63 |
| Fe | 0.19 | 0.30 |
| Si | 0.09 | 0.12 |
| Mn | 0.02 | 0.07 |
| Mg | 2.40 | 2.48 |
| Zn | 5.92 | 5.68 |
| Ni | 0.00 | 0.00 |
| Cr | 0.18 | 0.19 |
| Ti | 0.02 | 0.05 |
| Be | 0.001 | 0.001 |

FIG. 2 shows the 7075 alloy material of FIG. 1 after it has been brought to the T6, in particular the T651, temper by heating W51 material in a circulatory-air furnace for 24 hours at 250° F. E-phase remains substantially unchanged. Dislocations D and a grain boundary B are shown. Now in the matrix there has appeared many small black dots; these are referred to as G.P. zones and are clusterings of magnesium and zinc atoms generally in the ratio two zinc atoms for each magnesium atom.

FIG. 3 shows a specimen taken from the same plate of FIGS. 1 and 2 in the T73 condition, which is produced from W51 material by heating in circulatory-air furnaces for, first, 24 hours at 250° F. and, second, 8 hours at 350° F. Grain boundary precipitate 10 has appeared, and the G.P. zones have grown to greater size. The G.P. zones have begun to exhibit crystallinity by giving rise to X-ray diffraction patterns and are referred to by those in the art as M′ and M phase. Solution potential studies indicate that the M′ and M phases contain some copper atoms. It is believed that the G.P. zones progress toward crystallinity by becoming first M′ phase, which is still partially coherent with the matrix crystal structure. The M′ phase then changes to M phase, which has a crystal structure different from the matrix. It is believed also that the progression through the M′ phase to the M phase makes the original G.P. zones increasingly anodic with respect to the matrix and that the resulting anodic particulate matter in the matrix protects against stress-corrosion cracking.

Further illustrative of the present invention are the following examples.

EXAMPLES 1 to 8

For each example, two tensile blanks of dimensions ⅜ inch by ⅜ inch by 2½ inches were cut from a single lot of 2½ inch thick 7075-T651 (metallurgical history as described for FIG. 2) alloy plate such that their lengths were in the short-transverse direction, i.e., in the direction perpendicular to the surface of the plate.

TABLE II

Times and Temperatures in Wood's Metal for Examples 1 to 8 and the Coordinates of Points A to H.

| Example No., or Point | Time, min. | Temperature, °F. |
|---|---|---|
| 1 | 0.5 | 475 |
| 2 | 1.0 | 475 |
| 3 | 1.5 | 445 |
| 4 | 4.0 | 445 |
| 5 | 7.0 | 400 |
| 6 | 15.0 | 400 |
| 7 | 7.0 | 375 |
| 8 | 15.0 | 375 |
| A | 20.0 | 360 |
| B | 0.2 | 500 |
| C | 1.0 | 500 |
| D | 150.0 | 360 |
| E | 20.0 | 380 |
| F | 0.8 | 480 |
| G | 1.2 | 480 |
| H | 40.0 | 380 |

The chemical composition of the alloy is as presented for alloy B in Table I. The tensile blanks for each example were immersed in molten Wood's metal of composition 50% bismuth, 25% lead, 12.5% tin and 12.5% cadmium. The immersion temperatures and times are presented in tubular form in Table II and are plotted in FIG. 4. Following immersion in the molten Wood's metal, the cooled specimens were then precipitation hardened by heating them in a circulatory-air furnace for a time of 24 hours at 250° F. In each of Examples 1 to 8, a tensile blank was machined to a 0.125 inch diameter tensile bar for exposure to 3½% sodium chloride solution by alternate immersion at a stress level of 42 ksi according to Military Specification MIL-A-22771B. The specimens were held until failure with successive immersions for 10 minutes in the salt solution followed by 50 minutes in air. The number of days until failure under such treatment is provided in FIG. 4 above time-temperature point for each Example. The remaining blank of each example was tested for yield strength. The yield strength data for Examples 1 to 8 are presented in FIG. 4, below the time-temperature points, in terms of percentage of a yield strength of 62.3 ksi for the T651 condition.

Further illustrative of the preferred embodiment of the invention wherein the second precipitation hardening step is carried out for 2 to 30 hours at a temperature of 270 and 320° F. are the following examples:

EXAMPLES 9 TO 14

Procedure was as described for Examples 1 to 8, except that all examples utilized an immersion in molten Wood's metal for 90 seconds at 445° F., before the second precipitation hardening. Other parameters and results were as presented in Table III. Examples 9 to 11 form one group of comparative examples characterized by 3 hours at temperature in the second precipitation hardening step, with Examples 12 to 14 forming a second group characterized by 24 hours at temperature in the second precipitation hardening step. The superior strength and corrosion resistance obtained when the second precipitation hardening was done for 2 to 30 hours at 270° to 320° F. will be apparent from comparison of the examples within the groups.

TABLE III

Parameters and Data for Examples 9 to 14, Involving Immersing Aluminum Alloy 7075-T651 in Molten Wood's Metal for 90 seconds At 445° F., Followed by a Second Precipitation Hardening Step.

| Example No. | Time (Hours) & Temperature (°F.) of Second Precipitation Hardening | Tensile Strength, ksi | Yield Strength ksi | Days to Fail 42 ksi load level | |
|---|---|---|---|---|---|
| 9 | 3 hrs./250° F. | 67.2 | 58.5 | 27 | 74 |
| 10 | 3 hrs/275° F. | 68.8 | 58.8 | 43 | 62 |
| 11 | 3 hrs./300° F. | 66.8 | 58.1 | 60 | 84 |
| 12 | 24 hrs./250° F. | 70.5 | 62.9 | 49 | 50 |
| 13 | 24 hrs./275° F. | 69.5 | 61.0 | 47 | 61 |
| 14 | 24 hrs./300° F. | 69.6 | 61.4 | 56 | 63 |

The following definitions hold herein:

a. The term "ksi" is equivalent to kilipounds per square inch.

b. Wherever percentages are given, reference is to % by weight, unless indicated otherwise.

c. The initials "G.P." stand for Guinier-Preston.

It wil be understood that the above description of the present invention is susceptible to various modifications, changes ad adaptations, and the same are intended to be comprehended within the meaning and range of equivalents of the appended claims.

What is claimed is:

1. A method for thermally treating an alloy consisting essentially of about 4 to 8% zinc, about 1.5 to 3.5% magnesium, about 1 to 2.5% copper, and at least one element selected from the group consisting of: about 0.05 to 0.3% chromium, about 0.1 to 0.5% manganese and about 0.05 to 0.3% zirconium, the balance aluminum and incidental elements and impurities, said method comprising: (a) solution heat treating the alloy; (b) precipitation hardening the alloy in a first temperature range above room temperature; (c) subjecting the alloy to treatment within a second temperature range above the first temperature range and sufficient to improve corrosion resistance; (d) precipitation hardening the alloy in a third temperature range above room temperature but below the second temperature range to improve the relative strength of said alloy; and (e) the cumulative time in said second temperature range being greater than 3 minutes and sufficient to improve corrosion resistance but not so long as to prevent imparting a substantial strength increase in said recitation (d), said method imparting improved combinations of strength and corrosion resistance properties to the alloy.

2. The method as claimed in claim 1 wherein the first temperature range includes temperatures within about 175° F. to 325° F.

3. The method as claimed in claim 1 wherein the first temperature range is substantially the same as the third temperature range.

4. The method as claimed in claim 1 wherein the first and third temperature ranges include temperatures within about 175°-325° F.

5. The method as claimed in claim 1 wherein the second temperature range is about 360 to about 500° F. and said cumulative time in said temperature range is about four minutes or more.

6. The method as claimed in claim 1 wherein the second temperature range is about 360° F. to about 430° F. and said cumulative time in said second temperature range is about four minutes or more.

7. The method as claimed in claim 1 wherein the second temperature range is about 360° to about 410° F. and said cumulative time in said second temperature range is about five minutes more.

8. The method as claimed in claim 1 wherein said treatment according to recitation (c) extends for about five minutes or more and corresponds to time-temperature equivalence substantially within ABCD of FIG. 4.

9. The method as claimed in claim 1 wherein said treatment according to recitation (c) extends for about seven minutes or more and corresponds to time-temperature equivalence substantially within ABCD of FIG. 4.

10. The method as claimed in claim 1 wherein the second temperature range is about 380° F. to about 480° F. and corresponds to time-temperature equivalence substantially within EFGH of FIG. 4.

11. The method as claimed in claim 1 wherein the resuting alloy has corrosion resistance properties greater than the T6 condition and a relative strength greater than the T7 condition.

12. The method as claimed in claim 11 wherein the resulting alloy has a relative strength greater than the T73 condition.

13. The method as claimed in claim 1 which includes: working the alloy into a wrought condition.

14. A method for thermally treating a 7XXX aluminum alloy containing about 4% or more zinc, about 1.5% or more magnesium, about 1% or more copper and one or more of: chromium, manganese and zirconium, said method comprising: (a) providing the alloy in a precipitation hardenable condition; (b) precipitation hardening the alloy including treating within about 175°-325° F.; (c) subjecting the alloy to treatment for more than three minutes at one or more temperatures sufficient for improving the corrosion resistance of said alloy and achieving a cumulative time-temperature equivalence substantially within the perimeter ABCD of FIG. 4; and (d) precipitation hardening the alloy including treating within about 175°-325° F. to improve its strength, said method imparting improved combinations of strength and corrosion resistance properties to the alloy.

15. The method as claimed in claim 14 wherein recitation (c) includes subjecting the alloy to one or more temperatures within about 360° F. to about 500° F. for a cumulative time within 360° F. to 500° F. of about four minutes or more.

16. The method as claimed in claim 14 wherein recitation (c) includes subjecting the alloy to one or more temperatures within about 360° F. to about 500° F. for a cumulative time within 360° F. to 500° F. of about five minutes or more.

17. The method as claimed in claim 14 wherein recitation (c) includes subjecting the alloy to treatment within about 360° to about 420° F. for a cumulative time of five minutes or more and within the perimeter ABCD of FIG. 4.

18. A method for treating an aluminum 7XXX alloy containing about 4% or more zinc, about 1.5% or more magnesium and about 1% or more copper, said method comprising:

(a) providing the alloy in a wrought precipitation-hardenable condition;

(b) subjecting the alloy to one or more precipitation-hardening temperatures above room temperature to effect some precipitation therein;

(c) treating the alloy for a cumulative time of about four minutes or more at one or more elevated temperatures sufficient to improve the corrosion resistance thereof, said treating imparting thereto cumulative time-temperature effect substantially within ABCD of FIG. 4;

(d) subjecting said alloy to one or more precipitation-hardening temperatures above room temperature to impart a significant strength increase to said alloy;

19. The method according to claim 18 wherein either or both of said recitations (b) and (d) includes subjecting said alloy to one or more temperatures within about 175° F. to 325° F.

20. The method according to claim 18 wherein said alloy consists essentially of about 4 to 8% zinc, about 1.5 to 3.5% magnesium, about 1 to 2.5% copper, and one or more of about 0.05 to 0.3% chromium, about 0.1 to 0.5% manganese, and about 0.05 to 0.3% zirconium, the balance aluminum and incidental elements and impurities.

21. The method according to claim 18 wherein recitation (c) includes subjecting said alloy to one or more temperatures within about 360° to 500° F.

22. A method for treating an aluminum 7XXX alloy containing zinc, magnesium and copper comprising:

(a) providing the alloy in a precipitation-hardenable condition;

(b) subjecting the alloy to one or more precipitation hardening temperatures above room temperature to effect some precipitation therein;

(c) subjecting the alloy to treatment at one or more temperatures sufficient to improve the corrosion resistance thereof;

(d) subjecting the alloy to one or more precipitation-hardening temperatures above room temperature to significantly increase the strength of said alloy;

(e) the cumulative time at temperatures sufficient to improve corrosion resistance in said recitation (c) being about 5 minutes or more and sufficient to improve corrosion resistance but not so long as to prevent a significant strength increase in said recitation (d).

23. The method according to claim 22 wherein said alloy consists essentially of about 4 to 8% zinc, about 1.5 to 3.5% magnesium, about 1 to 2.5% copper, and one or more of about 0.05 to 0.3% chromium, about 0.1 to 0.5% manganese, and about 0.05 to 0.3% zirconium, the balance aluminum and incidental elements and impurities.

24. The method according to claim 22 wherein either or both of said recitations (b) and (d) includes subjecting said alloy to one or more temperatures within about 175° to 325° F.

25. The method according to claim 22 wherein said recitation (c) produces time-temperature equivalence substantially within ABCD of FIG. 4.

26. The method according to claim 22 wherein the cumulative time in recitation (e) is from about 6 minutes to about two and one-half hours.

27. The method according to claim 22 wherein the cumulative time in recitation (e) is from about 7 minutes to about two and one-half hours.

28. The method for treating an aluminum alloy consisting essentially of about 4 to 8% zinc, about 1.5 to 3.5% magnesium, about 1 to 2.5% copper, and one or more of the group of about 0.05 to 0.3% chromium, about 0.1 to 0.5% manganese, and about 0.05 to 0.3% zirconium, the balance aluminum and incidental elements and impurities, comprising:

(a) providing said alloy in wrought precipitation-hardenable condition;

(b) subjecting the alloy to one or more temperatures within about 175° to 325° F. to effect some precipitation therein;

(c) subjecting the alloy to treatment at one or more temperatures within about 360° to 500° F. ;

(d) subjecting the alloy to one or more temperatures within about 175° to 325° F. to significantly increase the strength of said alloy;

(e) the cumulative time at temperatures within about 360° to about 500° F. in said recitation (c) being from about 4 minutes to about two-and-one-half hours and sufficient to improve corrosion resistance but not so long as to prevent a significant strength increase in said recitation (d).

29. The method according to claim 28 wherein either or both of said recitations (b) and (d) includes subjecting the alloy to one or more temperatures within about 175° to 325° for about two hours or more.

30. The method according to claim 28 wherein said recitation (c) produces time-temperature equivalence substantially within ABCD of FIG. 4.

31. The method according to claim 28 wherein said cumulative time in said recitation (e) is about 5 minutes or more.

32. A method for treating a 7XXX aluminum alloy containing zinc, magnesium and copper, comprising:

(a) providing said alloy in a wrought precipitation-hardenable condition;

(b) subjecting said alloy to one or more temperatures within about 175° to 325° F. to effect some precipitation therein;

(c) increasing the temperature of said alloy to one or more temperatures within about 360° to about 500° F. and subjecting said alloy to treatment at temperatures within said 360° to 500° F. for cumulative time within 360° to 500° of about 4 minutes to about two-and-one-half hours, said treatment substantially corresponding to time-temperature equivalence substantially within ABCD of FIG. 4 and improving the corrosion resistance of said alloy;

(d) subjecting said alloy to one or more temperatures within about 175° to 325° F. to significantly increase the strength of said alloy.

33. The method according to claim 32 wherein said alloy consists essentially of about 4 to 8% zinc, about 1.5 to 3.5% magnesium, about 1 to 2.5% copper, and one or more of the group of about 0.5 to 0.3% chromium, about 0.1 to 0.5% manganese, and about 0.05 to 0.3% zirconium, the balance aluminum and incidental elements and impurities.

34. The method according to claim 32 wherein recitation (c) includes subjecting said alloy to one or more temperatures within about 360° to 440° F. for a cumulative time within about 360° to 440° of about 5 minutes or more.

35. A method for treating an aluminum alloy consisting essentially of about 4 to 8% zinc, about 1.5 to 3.5% magnesium, about 1 to 2.5% copper, and one or more of about 0.05 to 0.3% chromium, about 0.1 to 0.5% manganese, and about 0.05 to 0.3% zirconium, the balance aluminum and incidental elements and impurities, comprising:

(a) providing said alloy in a wrought precipitation-hardenable condition;

(b) subjecting the alloy to one or more temperatures within about 175° to 325° F. to impart some precipitation therein;

(c) subjecting the alloy to treatment within a temperature range of about 360° to 480° F. for a cumulative time within said range of about 4 minutes to about two-and-one-half hours, said treatment substantially corresponding to time-temperature equivalence substantially within ABCD of FIG. 4;

(d) subjecting the alloy to one or more temperatures within about 175° to 325° F. to significantly increase the strength of said alloy.

36. A method for treating a 7XXX aluminum alloy containing about 4% or more zinc, about 1.5% or more magnesium and about 1% or more copper to improve strength and corrosion resistance property combinations comprising:

(a) providing said alloy in a solution heat treated condition;

(b) subjecting said alloy to one or more temperatures within about 175° to 325° F. for a substantial cumulative time within about 175° to 325° F.;

(c) subjecting the alloy to one or more temperatures within about 360° to 500° F. for a cumulative time within 360° to 500° F. of about four minutes to about two and one-half hours;

(d) subjecting said alloy to one or more temperatures within about 175° to 325° F. for a cumulative time within about 175° to 325° F. sufficient to significantly strengthen the alloy;

(e) said subjecting in said recitation (c) not being excessive to obtaining a significant strength increase in said recitation (d).

37. The method according to claim 36 wherein said cumulative time in recitation (b) is about 3 hours or more within 175° to 325° F.

38. The method according to claim 36 wherein said cumulative time in recitation (d) is about 2 hours or more within 175° to 325° F.

39. The method according to claim 36 wherein recitation (c) includes subjecting the alloy to one or more temperatures within about 370° to 430° F.

40. The method according to claim 36 wherein said subjecting in recitation (c) imparts time-temperature equivalence substantially within ABCD of FIG. 4.

41. The method according to claim 36 wherein said alloy consists essentially of about 4 to 8% zinc, about 1.5 to 3.5% magnesium, about 1 to 2.5% copper, and one or more of about 0.05 to 0.3% chromium, about 0.1 to 0.5% manganese, and about 0.05 to 0.3% zirconium, the balance aluminum and incidental elements and impurities.

42. The method according to claim 36 wherein recitation (c) includes subjecting the alloy to one or more temperatures within about 360° to 450° F.

43. A method for treating a 7XXX aluminum alloy containing zinc, magnesium and copper comprising:

(a) providing said alloy in a solution heat treated condition;

(b) subjecting said alloy to one or more temperatures within about 175° to 325° F. for a cumulative time within about 175° to 325° F. of about three hours or more;

(c) subjecting the alloy to one or more temperatures within about 360° to 480° F. for a cumulative time within 360° to 480° F. of about four minutes to about two and one-half hours to impart to said alloy time-temperature equivalence substantially within ABCD of FIG. 4;

(d) subjecting the alloy to one or more temperatures within about 175° to 325° F. for a cumulative time within 175° to 325° F. of about 2 hours or more to significantly strengthen the alloy.

44. The method according to claim 43 wherein said alloy consists essentially of about 4 to 8% zinc, about 1.5 to 3.5% magnesium, about 1 to 2.5% copper, and one or more of about 0.05 to 0.3% chromium, about 0.1 to 0.5% manganese, and about 0.05 to 0.3% zirconium, the balance aluminum and incidental elements and impurities.

45. The method according to claim 43 wherein recitation (c) includes subjecting the alloy to one or more temperatures within about 370° to 430° F.

46. A method for treating a 7XXX aluminum alloy containing about 4% or more zinc, about 1.5% or more magnesium and about 1% or more copper, said method comprising:

(a) providing said alloy in solution heat treated condition;

(b) subjecting said alloy to one or more temperatures within about 175° to 325° F. for a substantial cumulative time within about 175° to 325° F. ;

(c) subjecting said alloy to one or more temperatures within about 360° to 490° F. for a cumulative time within 360° to 490° F. of about four minutes to about two and one-half hours;

(d) subjecting the alloy to one or more temperatures within about 175° to 325° F. for a cumulative time within about 175° to 325° F. sufficient to increase the strength thereof;

(e) said subjecting in said recitation (c) not being excessive to obtaining a significant strength increase in said recitation (d).

47. The method according to claim 46 wherein said cumulative time in recitation (b) is about 3 hours or more within 175° to 325° F.

48. The method according to claim 46 wherein said cumulative time in recitation (d) is about 2 hours or more within about 175° to 325° F.

49. The method according to claim 46 wherein recitation (c) includes subjecting the alloy to one or more temperatures within about 370° to 430° F.

50. The method according to claim 46 wherein said subjecting in recitation (c) imparts time-temperature equivalence substantially within ABCD of FIG. 4.

51. The method according to claim 46 wherein said subjecting in recitation (c) imparts time-temperature equivalence substantially within EFGH of FIGS. 4.

52. The method according to claim 46 wherein said alloy consists essentially of about 4 to 8% zinc, about 1.5 to 3.5% magnesium, about 1 to 2.5% copper, and one or more of about 0.05 to 0.3% chromium, about 0.1 to 0.5% manganese, and about 0.05 to 0.3% zirconium, the balance aluminum and incidental elements and impurities.

53. A method for treating an aluminum alloy consisting essentially of about 4 to 8% zinc, about 1.5 to 3.5% magnesium, about 1 to 2.5% copper, and one or more of about 0.05 to 0.3% chromium, about 0.1 to 0.5% manganese, and about 0.05 to 0.3% zirconium, the balance aluminum and incidental elements and impurities, said method comprising:

(a) providing said alloy in a wrought precipitation-hardenable condition;

(b) subjecting said alloy to one or more temperatures within about 175° to 325° F. for a cumulative time within about 175° to 325° F. of about 3 hours or more;

(c) increasing the temperatures of said alloy and subjecting said alloy to one or more temperatures within about 360° to 500° F. for a cumulative time within 360° to 500° F. of about 4 minutes to about two and one-half hours to impart to said alloy time-temperature equivalence substantially within ABCD of FIG. 4;

(d) subjecting said alloy to one or more temperatures within about 175° to 325° F. for a cumulative time within about 175° to 325° F. of about two hours or more to significantly increase the strength thereof.

54. The method according to claim 53 wherein recitation (c) includes subjecting the alloy to one or more temperatures within about 370° to 430° F.

55. The method according to claim 53 wherein said recitation (c) includes subjecting the alloy to one or more temperatures within about 360° to 450° F.

56. The method for treating a 7XXX aluminum alloy containing zinc, magnesium and copper, said method comprising:

(a) providing said alloy in a wrought precipitation-hardenable condition;

(b) subjecting said alloy to one or more temperatures in the range of about 175° to 325° F. for a cumulative time of about 3 hours or more in said range;

(c) subjecting the alloy to one or more temperatures within about 360° to 460° F. for a cumulative time within 360° to 460° F. of about 5 minutes or more and imparting thereto a cumulative time-temperature effect substantially within ABCD of FIG. 4;

(d) subjecting said alloy to one or more temperatures within about 175° to 325° F. for a cumulative time of about 2 hours or more within 175° to 325° F. to impart a significant strength increase to said alloy.

57. The method according to claim 18 wherein recitation (c) includes subjecting said alloy to one or more temperatures within about 360° to 460° F.

58. The method according to claim 57 wherein the cumulative time in recitation (c) is about 5 minutes or more.

59. The method for imparting improved combinations of strength and corrosion resistance to a solution heat treated alloy consisting essentially of about 4 to 8% zinc, about 1.5 to 3.5% magnesium, about 1 to 2.5% copper, about 0.05 to 0.3% zirconium, the balance aluminum and incidental elements and impurities, said method comprising: (a) treating the alloy at more than one elevated temperature to: (i) form hardening precipitates therein; and (ii) improve its corrosion resistance, said treatment including heating within about 360°-500° F. for substantially more than three minutes to impart a cumulative time-temperature effect substantially within ABCD of FIG. 4; and (b) precipitation hardening the alloy including treating at one or more tmeperatures between about 175°-325° F. to increase its strength.

60. The method as claimed in claim 59 wherein (i) of recitation (a) includes treating the alloy for at least about two hours between about 175°-325° F. to form hardening precipitates before heating the alloy for said cumulative-temperature effect.

61. The method as claimed in claim 60 wherein said cumulative time-temperature effect in (ii) of recitation (a) is greater than or equal to about five minutes and within the perimeter ABCD of FIG. 4.

62. The product produced by the method of claim 1.

63. The product produced by the method of claim 14.

64. The product produced by the method of claim 18.

65. The product produced by the method of claim 22.

66. The product produced by the method of claim 35.

67. The product produced by the method of claim 36.

68. The product produced by the method of claim 43.

69. The product produced by the method of claim 46.

70. The product produced by the method of claim 53.

71. The method according to claim 35 wherein said cumulative time in said recitation (c) is 5 minutes or more.

72. The method according to claim 36 wherein said cumulative time in said recitation (c) is 5 minutes or more.

73. The method according to claim 43 wherein said cumulative time in said recitation (c) is 5 minutes or more.

74. The method according to claim 46 wherein said cumulative time in said recitation (c) is 5 minutes or more.

75. The method according to claim 53 wherein said cumulative time in said recitation (c) is 5 minutes or more.

* * * * *